United States Patent [19]

Blough et al.

[11] 4,446,763

[45] May 8, 1984

[54] MORTICE CYLINDER LOCK WRENCH STRUCTURES

[76] Inventors: LeVone A. Blough, 95 Horseshoe Dr., Longwood, Fla. 32779; David L. Gregory, 10207 Union Park Dr., Orlando, Fla. 32817

[21] Appl. No.: 337,839

[22] Filed: Jan. 7, 1982

Related U.S. Application Data

[63] Continuation-in-part of Ser. No. 146,213, May 5, 1980, abandoned.

[51] Int. Cl.[3] ..... B25B 13/02

[52] U.S. Cl. ..... 81/90 B

[58] Field of Search ..... 81/90 R, 90 B, 90 C, 81/90 D, 121 R, 121 B, 177 R; 70/466; 220/286, 274; D8/347; 29/250

[56] References Cited

U.S. PATENT DOCUMENTS 3,185,001 5/1965 Viator ..... 81/177 R 4,252,037 2/1981 Raine ..... 81/121 B X

*Primary Examiner*—James G. Smith

*Attorney, Agent, or Firm*—Kenneth E. Darnell

[57] ABSTRACT

Apparatus for removing and replacing a standard mortice cylinder or mortice thumbturn lock, the invention includes particular wrench structures for removing a mortice lock which has been drilled in order to cut away the set screw or cylinder yoke holding the cylinder in the door or other structures in which the lock is installed. The present wrench structures are also useful for removal of the mortice cylinder when the threads of the cylinder are crossed, when the cylinder is corroded, or when the screw head is broken. The present structures particularly allow removal and installation of mortice locks and similar locking apparatus with minimal damage to the lock face and without damage to the keyway, the expensive keyway thus being reuseable.

7 Claims, 5 Drawing Figures

FIG. 1
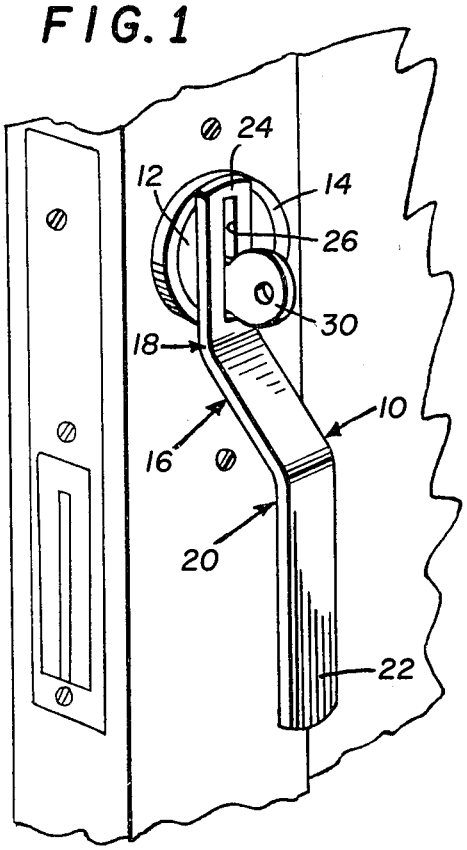
FIG. 4a
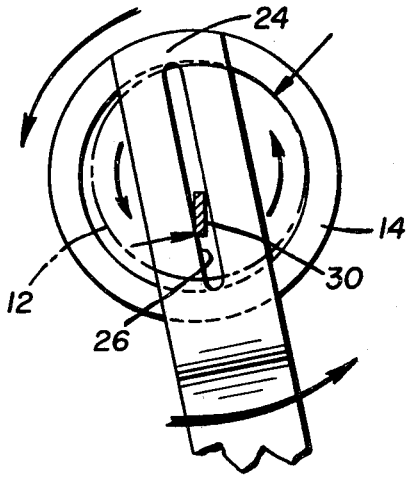
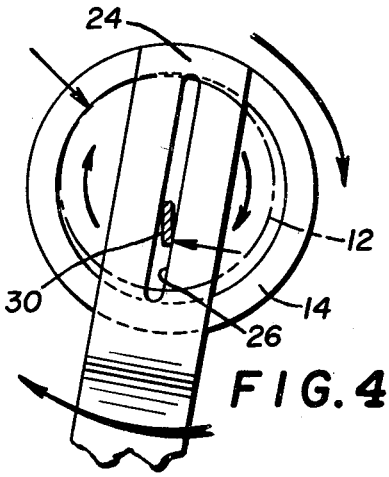
FIG. 4b
FIG. 2
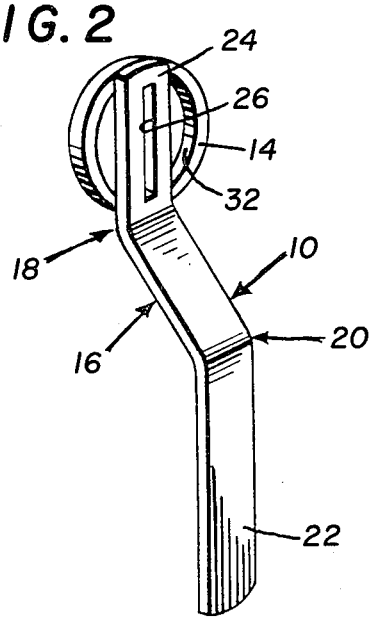
FIG. 3
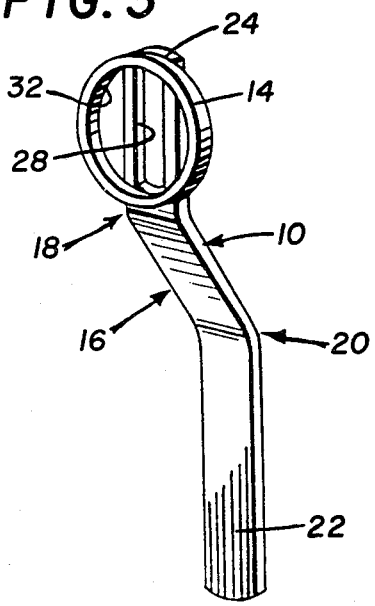

MORTICE CYLINDER LOCK WRENCH STRUCTURES

CROSS-REFERENCE TO RELATED APPLICATION

This application is a continuation-in-part of U.S. patent application Ser. No. 146,213, filed May 5, 1980, now abandoned as of the filing date of this application.

BACKGROUND OF THE INVENTION

1. Field of the Invention

The invention relates generally to apparatus for removal and replacement of mortice locks and similar locking structure with minimal damage to the lock. In particular, the invention relates to wrench structures which allow rapid removal of the cylinder of a mortice lock without damage to the keyway.

2. Description of the Prior Art

Mortice and mortice thumbturn locks, as well as similar locking apparatus, are widely used, particularly in metal doors such as are common in commercial buildings including motels, hotels, stores, and the like. The mortice lock includes a cylinder which is held in the door by a set screw or cylinder yoke. From time to time, such locks need to be replaced for differing reasons. Various tools have previously been employed by the locksmith to remove such locks. These prior tools, which include pliers, vice grips, pipe wrenches, etc., unfailingly causing damage to and mar the edges of the lock face. These previous practices typically have resulted in the need for replacing the complete cylinder and, in many instances, the keyway itself which is expensive and often difficult to obtain since many such keyways are master keyed or otherwise keyed to form a part of a series of locks. Accordingly, in situations where mortice locks are to be removed, replaced or installed, it is desirable not only to cause as little cosmetic damage to the lock as possible, but it is also necessary to prevent damage to the keyway due to the expense and difficulty of obtaining a new keyway or core which would have a pin setting compatible with locks already in place in a building or series of buildings. The present invention provides apparatus capable of removing and replacing standard mortice cylinder locks with minimal damage to the lock face and without damage to the core or keyway of the lock. Apparatus provided according to the invention includes wrench structures which fit about the face of the cylinder of the lock to allow the cylinder to be loosened even in situations where the cylinder threads are crossed or the cylinder is corroded. Use of the invention is facilitated by drilling of the lock to cut away the set screw or yoke, the wrenches of the invention being then particularly useful to remove the cylinder from an installed position. Further, the present wrench allows a new mortice lock to be rapidly installed with a minimum of effort and without damage, either cosmetic or otherwise, to the lock.

SUMMARY OF THE INVENTION

The present invention provides particular apparatus which is useful for removing and replacing standard mortice cylinder or mortice thumbturn locks both rapidly and without damage to the keyway or core of the lock. The invention can be used with a template structure or drill jig which fits over the face of the lock and allows exact positioning of a drill so that the end of a set screw holding the lock in a door can be cut away without damage to the keyway core of the cylinder, thereby saving the usually restricted and often difficult to obtain key way so that the same pin setting can be reused in order to be compatible with other cylinder locks which are similarly keyed. A drill template such as can be efficaciously used with the present wrench structures is disclosed in now abandoned U.S. patent application Ser. No. 146,213, of which the present patent application is a continuation-in-part and in U.S. patent application Ser. No. 337,840 which is a divisional of abandoned U.S. patent application Ser. No. 146,213. This drill template has a first aperture extending normally therethrough to allow use with cylinders such as the Medeco rim cylinder. A second aperture disposed on the other side of a central slot disposed in the template is angled for use with certain other mortice lock cylinders.

Once the head of the set screw has been cut away through the use of the drill template as aforesaid, wrench structures configured according to the present invention can be used to remove the mortice cylinder even though the threads of the cylinder may be crossed or the cylinder corroded. The present wrenches can be used both to remove and to install a cylinder. In situations where the set screw is already broken, the present wrenches can be solely used to remove the cylinder lock. It is even possible to use the present wrench structures on a cylinder lock, particularly a pick-resistant cylinder lock, to break the set screw without prior drilling. In all situations, the present wrench structures allow removal or installation of the cylinder lock without marking the edge of the lock face such as occurs when a pipe wrench or similar piece of equipment is used in a crude effort to remove such a lock. Further, use of the present apparatus reduces the time necessary for lock removal and installation and reduces the possibility of damage to the lock keyway.

Accordingly, it is an object of the invention to provide apparatus for removing and replacing a standard mortice cylinder or mortice thumbturn lock with a minimum of damage to the lock face and without damage to the keyway core of the lock, thereby enabling the reuse of the pin setting.

It is another object of the invention to provide a wrench structure which allows rapid and safe removal of a mortice cylinder from a door either with or without prior removal of a set screw head of a cylinder yoke holding the cylinder in the door, the present wrench being particularly useful when the threads of the cylinder are crossed, when the cylinder is corroded, or when the screw head is broken.

Further objects and advantages of the invention will become more readily apparent in light of the following detailed description of the preferred embodiments.

BRIEF DESCRIPTION OF THE DRAWINGS

FIG. 1 is a perspective view of a wrench configured according to the present invention, the wrench being shown in position over a lock cylinder during removal or installation of the lock;

FIG. 2 is a perspective view of a wrench configured according to the present invention and being particularly configured to utilize a lock key to serve as a fulcrum during removal and installation of the lock;

FIG. 3 is a perspective view from the underside of a wrench configured according to a second embodiment of the present invention and wherein the wrench is configured to accept a thumbturn to act as a fulcrum during removal and installation of a mortice lock; and, FIGS. 4*a* and 4*b* are schematic views illustrating contact between a wrench, key and lock in certain useage modes.

DESCRIPTION OF THE PREFERRED EMBODIMENTS

Referring now to the drawings, and particularly to FIGS. 1–3, two embodiments of a cylinder wrench 10 configured according to the invention are shown. The wrenches 10 are configured to act in concert with a drill template such as is disclosed in now abandoned U.S. patent application Ser. No. 146,213 of which the present patent application is a continuation-in-part and in U.S. patent application Ser. No. 337,840 which is a divisional of abandoned U.S. patent application Ser. No. 146,213. This drill template is useful to facilitate cutting away of a set screw of a cylinder yoke in a mortice lock or similar lock to facilitate removal and replacement of such a mortice lock. As particularly seen in FIG. 1, the cylinder wrench 10 is seen in a use situation to be disposed over the lock 12 which has been drilled to remove a holding set screw through use of a drill template such as is referred to above. Once the structure which positively holds the lock 12 within the door or other installation has been removed, the wrench 10 is utilized to rotate the lock 12 out of the door. The wrench 10 is thus used to manually "unscrew" the lock 12 from the door when said lock is to be removed. Conversely, the wrench 10 is also used to screw a replacement lock into place within the door. The cylinder wrench 10 is particularly useful in those situations where the threads of the cylinder lock are crossed or the cylinder has become corroded in the door. The wrench 10 can also be used as described without damaging the cylinder or marring the edge of the lock face. Removal of the lock 12 without damage to the lock case is particularly important, such damage requiring replacement of the complete cylinder and often resulting in damage to the keyway or core of the lock.

As particularly seen in FIGS. 1–3, the wrench 10 is seen to comprise an annular body member 14 having a handle 16 attached thereto. The handle 16 is preferably formed of flat steel stock which is angularly bent at 18 and 20, anterior portion 22 of the handle 16 being substantially parallel to distal portion 24 which contacts the annular body member 14. The distal portion 24 is seen to be slotted in FIGS. 2 and 3, the wrench 10 of FIG. 2 having a slot 26 which is essentially 0.11 inch wide while the wrench 10 of FIG. 3 has a slot 28 which is approximately 3 times greater in width than the slot 26. As will be seen also in FIGS. 4*a* and 4*b*, the slot 26 is sized to accept the outwardly extending portion of a key 30 therethrough when the wrench 10 is located over a cylinder lock which is to be removed or installed. The key 30 serves as a fulcrum for operation of the wrench 10 of FIGS. 1 and 2 and a portion of the inner surface of the slot 26 engages a surface portion of the key 30 as seen in FIGS. 4*a* and 4*b*. At least a portion of inner surface 32 of the annular body member 14 also abuts opposite portions of the circular outer edge surface of the cylinder of the mortice lock 12 to provide the additional contact necessary to rotate the lock 12. While the inner diameter of the annular body member 14 can be sized to be only slightly greater than the outer diameter of the lock 12, such that a substantially flush fit can occur therebetween, it is preferred that the inner diameter of the annular body member 14 be sufficiently greater than the outer diameter of the lock 12 such that a clearance exists therebetween when the annular body member 14 is centered on the lock 12. Choosing the inner diameter of the annular body member 14 to be greater than standard Medeco locks serves at least in part to allow the wrench to fit over various locks of differing size. Further, this clearance allows the wrench 10 to be manipulated to best advantage about the fulcrum provided by the key 30 (or a thumbturn for the wrench of FIG. 3) to engage a localized portion of the circular outer edge surface of the lock cylinder with an opposing portion of the inner surface 32 while simultaneously engaging a portion of the inner surface of the slot 26 with an opposing surface of the key 30, thereby to provide bearing engagement between the wrench 10 and both the key 30 and the cylinder of the lock 12. Accordingly, the mechanical advantage necessary to rotate the lock 12 on rotation of the wrench 10 is provided. While the extent of the fitting of the inner surface 32 against the outer edge surface of the cylinder of the mortice lock 12 may vary depending upon the relative diameters of the annular body member 14 and of the lock 12, a bearing engagement is thus provided therebetween and need only be an essentially tangential contact. This contact between the inner surface 32 of the annular body member 14 and the lock cylinder can be varied by the user of the wrench 10 and can be located virtually oppositely across from the key 30 or on a portion of the circular outer edge surface of the lock cylinder which is essentially adjacent to the key 30. In effect, however, the dual engagement afforded by contact and bearing engagement between two portions of the wrench 10 and both the key 30 ( or blank) or thumbturn (not shown) and a portion of the circular outer edge surface or equivalent structure of the lock 12 is necessary to facilitate rotation of the lock 12. The use simply of a wrench with an annular body member which fits flushly over a lock cylinder without the necessary mechanical advantage which is provided according to the invention is not sufficient to rotate the lock.

It is to be particularly noted that the key 30 can take the form of a key blank or cut key inserted into the keyway of the lock 12. In all such situations, a portion of the inner surfaces 32 of the slot 26 bears against an opposing portion of the key 30 to provide mechanical advantage necessary to rotate the lock 12. Any attempt to use the mechanical advantage solely provided by this contact between the key 30 and the inner surfaces 32 of the slot 26 may result in the breaking of the key 30. The operation of the wrench 10 as thus described above is accordingly advantageous.

The slot 28 of the wrench 10 of FIG. 3 is seen to be sized to similarly fit over a thumbturn (not shown) of a similar mortice lock, the thumbturn serving as a fulcrum to provide bearing surfaces to obtain mechanical advantage in the same manner as does the key 30.

While the cylinder wrenches 10 are particularly intended to be used to remove and replace a lock such as the lock 12 after drilling of the lock with a template as aforesaid, it is possible to utilize the wrenches 10 solely, particularly on cylinders which are pick-resistant, the mechanical advantage afforded by the wrenches 10 being often sufficient to break the set screw without drilling of the lock. Accordingly, the wrenches 10 can be rapidly used to remove even a cross-threaded or corroded lock without marking the edges of the lock face or otherwise damaging the cylinder case or keyway of the lock. In such situations, the set screw or yoke holding the cylinder from the edge of the door acts to break the set screw or yoke without breaking of the blank or cut key 30. Cylinders which are difficult to remove can be readily handled through use of the present wrenches 10 even though such a cylinder be provided with hardened collars. As is apparent from the foregoing, the wrenches 10 can also be used to install a lock by rotating the new lock in a counter-clockwise direction opposite to that required for removal of a lock.

It is believed apparent that the concepts explicitly illustrated herein can be practiced other than as expressly described without departing from the scope of the invention. Accordingly, the invention is intended to be understood in light of the description provided herein, but is to be properly limited in scope only by the recitations of the appended claims.

What is claimed is:

1. A wrench apparatus for removal of a cylinder of a mortice or similar lock from a structure in which the lock is installed, the lock being operable by a key or thumbturn, comprising wrench means for rotating the lock to remove the lock from the structure, the wrench means comprising:

an annular body member having an inner annular surface at least a portion of which engages at least a portion of outer edge surfaces of the lock cylinder, the engagement providing load-bearing contact therebetween on rotation of the wrench means; and, a body portion extending substantially diametrically across the annular body member and being attached thereto, the body portion having a longitudinal slot to receive the key or thumbturn associated with the lock, the slot extending diametrically across the annular body member with a portion of the slot lying over the center of the circle defined by the annular body member, inner edge surfaces of the slot bearing against the key or thumbturn to provide load-bearing contact therebetween on rotation of the wrench means.

2. The wrench apparatus of claim 1 and further comprising handle means attached to the wrench means for rotating the annular body member.

3. The wrench apparatus of claim 2 wherein the handle means comprise a handle member which is adapted to be manually grasped for rotation of the wrench apparatus.

4. The wrench apparatus of claim 3 wherein the handle member extends upwardly at angle from the body member and recurves axially to form an anterior portion adapted to be manually grasped.

5. A wrench apparatus for rotary displacement of a cylinder of a mortice lock or similar lock relative to a structure in which the lock is installed, the lock being operable by a key insertable into the keyway of the lock or by a thumbturn connected to the lock and having the key inserted into the keyway on use of the wrench to angularly displace the lock, comprising a wrench body adapted to rotate the lock relative to the structure to remove the lock from the structure or to insert the lock into the structure, the wrench body comprising an annular body member having an inner annular load-bearing surface at least a portion of which bears against at least a portion of outer edge surfaces of the lock cylinder, the direct contact between the portion of the inner annular surface of the annular body member and the portion of the edge surfaces of the lock cylinder providing a load-bearing engagement therebetween to cause torque forces to be exerted on the lock cylinder to rotate said cylinder on rotation of the wrench body, the wrench body further including a body portion which extends substantially diametrically across the annular body member and which is attached thereto on surfaces of the body member which are outwardly disposed of the wrench body relative to the lock when the wrench apparatus is disposed over the lock, the body portion being longitudinally slotted to provide an elongated slot for receiving the key or thumbturn therethrough, the slot extending diametrically across the annular body member with a portion of the slot lying over the center of the circle defined by the annular body member, inner edge surfaces of the slot bearing against the key or thumbturn to provide bearing engagement therebetween and to additionally facilitate rotation of the lock on rotation of the wrench apparatus, the present wrench apparatus acting to rotate and thus displace the lock without damage to the face thereof or to the keyway, and handle means joined to the wrench body for rotating the wrench apparatus.

6. The wrench apparatus of claim 5 wherein the handle means comprises an elongated handle member adapted to be manually grasped for rotation of the wrench body.

7. The wrench apparatus of claim 6 wherein the handle member extends upwardly at an angle from the body member and recurves axially to form an anterior portion adapted to be manually grasped.

* * * * *